US010109239B2

(12) United States Patent
In

(10) Patent No.: US 10,109,239 B2
(45) Date of Patent: Oct. 23, 2018

(54) ORGANIC LIGHT EMITTING DISPLAY DEVICE HAVING A GATE DRIVING CIRCUIT FOR OUTPUTTING A SENSING SIGNAL

(71) Applicant: Samsung Display Co., Ltd., Yongin-si, Gyeonggi-do (KR)

(72) Inventor: Hai-Jung In, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 15 days.

(21) Appl. No.: 15/178,318

(22) Filed: Jun. 9, 2016

(65) Prior Publication Data

US 2017/0162122 A1 Jun. 8, 2017

(30) Foreign Application Priority Data

Dec. 4, 2015 (KR) ..... 10-2015-0172176

(51) Int. Cl.

| | |
|---|---|
| ***G09G 3/32*** | (2016.01) |
| ***G09G 3/3266*** | (2016.01) |
| ***G09G 3/3291*** | (2016.01) |
| *G09G 3/3233* | (2016.01) |

(52) U.S. Cl.

CPC ..... *G09G 3/3266* (2013.01); *G09G 3/3291* (2013.01); *G09G 3/3233* (2013.01); *G09G 2300/0819* (2013.01); *G09G 2300/0842* (2013.01); *G09G 2310/0262* (2013.01); *G09G 2310/0286* (2013.01); *G09G 2320/0295* (2013.01); *G09G 2320/045* (2013.01); *G09G 2320/0693* (2013.01)

(58) Field of Classification Search

CPC ..... G09G 3/3266
USPC ..... 345/82, 100
See application file for complete search history.

(56) References Cited

U.S. PATENT DOCUMENTS

| | | | | |
|---|---|---|---|---|
| 2009/0051628 | A1* | 2/2009 | Kwon | G09G 3/3233 345/77 |
| 2011/0102388 | A1* | 5/2011 | Chin | G09G 3/3677 345/205 |
| 2015/0379940 | A1* | 12/2015 | Kishi | G09G 3/3225 345/690 |
| 2017/0025061 | A1* | 1/2017 | Takizawa | G09G 3/3233 |
| 2017/0162101 | A1* | 6/2017 | Ohara | G09G 3/2018 |

FOREIGN PATENT DOCUMENTS

| | | | |
|---|---|---|---|
| KR | 10-2004-0061210 | A | 7/2004 |
| KR | 10-2004-0092775 | A | 11/2004 |
| KR | 10-2011-0028752 | A | 3/2011 |
| KR | 10-2014-0133033 | A | 11/2014 |
| KR | 10-22015-0057190 | A | 5/2015 |
| WO | WO 2015/093100 | * | 6/2015 |

* cited by examiner

*Primary Examiner* — Long D Pham
(74) *Attorney, Agent, or Firm* — Lewis Roca Rothgerber Christie LLP

(57) ABSTRACT

A gate driving circuit including a plurality of stages to respectively output a plurality of scan signals, an N-th stage of the stages includes: a shift register to output an N-th scan signal based on an (N−1)-th scan signal; and a sensing signal output block connected to the shift register and to output an (N−1)-th sensing signal for compensation of a pixel based on a sensing control signal and a data control signal, where N is an integer greater than 1.

18 Claims, 9 Drawing Sheets

ORGANIC LIGHT EMITTING DISPLAY DEVICE HAVING A GATE DRIVING CIRCUIT FOR OUTPUTTING A SENSING SIGNAL

CROSS REFERENCE TO RELATED APPLICATION

This application claims priority to and the benefit of Korean Patent Application No. 10-2015-0172176, filed on Dec. 4, 2015 in the Korean Intellectual Property Office (KIPO), the disclosure of which is hereby incorporated by reference herein in its entirety.

BACKGROUND

1. Field

One or more aspects of example embodiments of the inventive concept relate to display devices. More particularly, one or more aspects of example embodiments of the inventive concept relate to organic light emitting display devices and a gate driving circuit included in the same.

2. Discussion of Related Art

An organic light emitting display device displays images using organic light emitting diodes. Because degradation of the organic light emitting diodes and a difference in the threshold voltage/mobility of a driving transistor may occur, luminance variations and image blurring may be noticeable. Thus, data voltage compensations are performed to improve display quality. For example, an external compensation technique analyzes a sensing current generated in a pixel and compensates the data voltage (or the degradation) using a sensing circuit, which is arranged outside the pixels or the display panel.

In this case, a gate driver includes two driving circuits, for example, a sensing driver configured to output sensing signals for performing pixel sensing (or compensating) and a scan driver configured to output scan signals. Thus, a size of the gate driving circuit and a space for integrating the gate driving circuit in the display panel becomes larger, and thus, complexity of the gate driving circuit increases and yield of the gate driving circuit and the display device decreases.

The above information disclosed in this Background section is for enhancement of understanding of the background of the inventive concept, and therefore, it may contain information that does not constitute prior art.

SUMMARY

One or more aspects of example embodiments are directed toward a gate driving circuit having a plurality of stages, each of the stages for outputting a present scan signal and a previous sensing signal using an output of a single shift register.

One or more aspects of example embodiments are directed toward an organic light emitting display device including the gate driving circuit.

According to an example embodiment, a gate driving circuit includes: a plurality of stages configured to respectively output a plurality of scan signals, an N-th stage of the stages including: a shift register configured to output an N-th scan signal based on an (N−1)-th scan signal; and a sensing signal output block connected to the shift register and configured to output an (N−1)-th sensing signal for compensation of a pixel based on a sensing control signal and a data control signal, where N is an integer greater than 1.

In an embodiment, the sensing signal output block may include: a first switch connected to an output terminal of the shift register and configured to output the (N−1)-th sensing signal having an active level, based on the sensing control signal; and a second switch connected to a voltage source and configured to change the active level of the (N−1)-th sensing signal to an inactive level, based on the data control signal.

In an embodiment, the first switch may include: a gate electrode configured to receive the sensing control signal; a first electrode configured to receive the N-th scan signal; and a second electrode connected to an (N−1)-th sensing line, the (N−1)-th sensing line being configured to output the (N−1)-th sensing signal.

In an embodiment, the second switch may include: a gate electrode configured to receive the data control signal; a first electrode configured to receive a voltage of the voltage source; and a second electrode connected to the (N−1)-th sensing line.

In an embodiment, the sensing signal output block may be configured to maintain the (N−1)-th sensing signal at the inactive level in a display mode for displaying an image, and the sensing signal output block may be configured to output the (N−1)-th sensing signal at the active level in a sensing mode for the compensation.

In an embodiment, the data control signal may have the active level and the sensing control signal may have the inactive level in the display mode.

In an embodiment, the sensing mode may include a writing period for writing a sensing voltage to the pixel and a sensing period for sensing a sensing current that is generated based on the sensing voltage, the data control signal may have the active level in the writing period, and the sensing control signal may have the active level in the sensing period.

In an embodiment, in the sensing mode, a period in which the (N−1)-th sensing signal having the active level may overlap a portion of a period in which the N-th scan signal has the active level.

According to an example embodiment, an organic light emitting display device includes: a display panel including a plurality of pixels configured to be driven by a display mode and a sensing mode; a data driving circuit configured to provide a data voltage corresponding to an image to the display panel in the display mode, and to provide a sensing voltage to the display panel based on a data control signal; a gate driving circuit configured to sequentially provide a plurality of scan signals to the display panel in the display mode and the sensing mode, and to sequentially provide a plurality of sensing signals to the display panel based on the data control signal and a sensing control signal in the sensing mode; a sensing circuit configured to compensate the pixels based on a sensing current generated by the pixels in the sensing mode; a power supply configured to provide a first power voltage and a second power voltage less than the first power voltage, to the display panel; and a controller configured to control the data driving circuit, the gate driving circuit, the sensing circuit, and the power supply.

In an embodiment, the gate driving circuit may include a plurality of stages configured to respectively output the scan signals, and an N-th stage of the stages may include: a shift register configured to output an N-th scan signal based on an (N−1)-th scan signal; and a sensing signal output block connected to the shift register and configured to output an (N−1)-th sensing signal for the compensation based on the sensing control signal and the data control signal, where N is an integer greater than 1.

In an embodiment, the sensing signal output block may include: a first switch connected to an output terminal of the shift register and configured to output the (N−1)-th sensing signal having an active level, based on the sensing control signal; and a second switch connected to a voltage source and configured to change the active level of the (N−1)-th sensing signal to an inactive level, based on the data control signal.

In an embodiment, the sensing signal output block may be configured to maintain the (N−1)-th sensing signal at an inactive level in the display mode, and the sensing signal output block may be configured to output the (N−1)-th sensing signal at an active level in the sensing mode.

In an embodiment, the data control signal may have the active level and the sensing control signal may have the inactive level in the display mode.

In an embodiment, the sensing mode may include a writing period for writing a sensing voltage to the pixels and a sensing period for sensing the sensing current, the data control signal may have the active level in the writing period, and the sensing control signal may have the active level in the sensing period.

In an embodiment, the sensing circuit may be configured to receive the sensing current based on the sensing control signal in the sensing mode.

In an embodiment, the sensing circuit may include: a sensing control switch configured to receive the sensing current from the pixels and including a gate electrode configured to receive the sensing control signal.

In an embodiment, the data driving circuit may include: a data control switch configured to transmit the data voltage or the sensing voltage to the pixels and including a gate electrode configured to receive the data control signal.

In an embodiment, in the sensing mode, a period in which the (N−1)-th sensing signal having the active level may overlap a portion of a period in which the N-th scan signal has the active level.

In an embodiment, the power supply may be configured to raise the second power voltage to have a voltage level that is the same as that of the first power voltage.

Therefore, the gate driving circuit according to one or more example embodiments may include stages, each stage including the single shift register and the simple sensing signal output block for outputting the scan signals and the sensing signals, without any additional shift registers for sequentially outputting the sensing signals. Thus, the structure of the gate driving circuit may be simplified and the output reliability of the gate driving circuit may be improved.

In addition, the organic light emitting display device may include the gate driving circuit such that a narrow bezel or a zero bezel display device can be implemented.

BRIEF DESCRIPTION OF THE DRAWINGS

Example embodiments may be understood in more detail from the following description taken in conjunction with the accompanying drawings, in which.

DETAILED DESCRIPTION OF EMBODIMENTS

Figure 1:
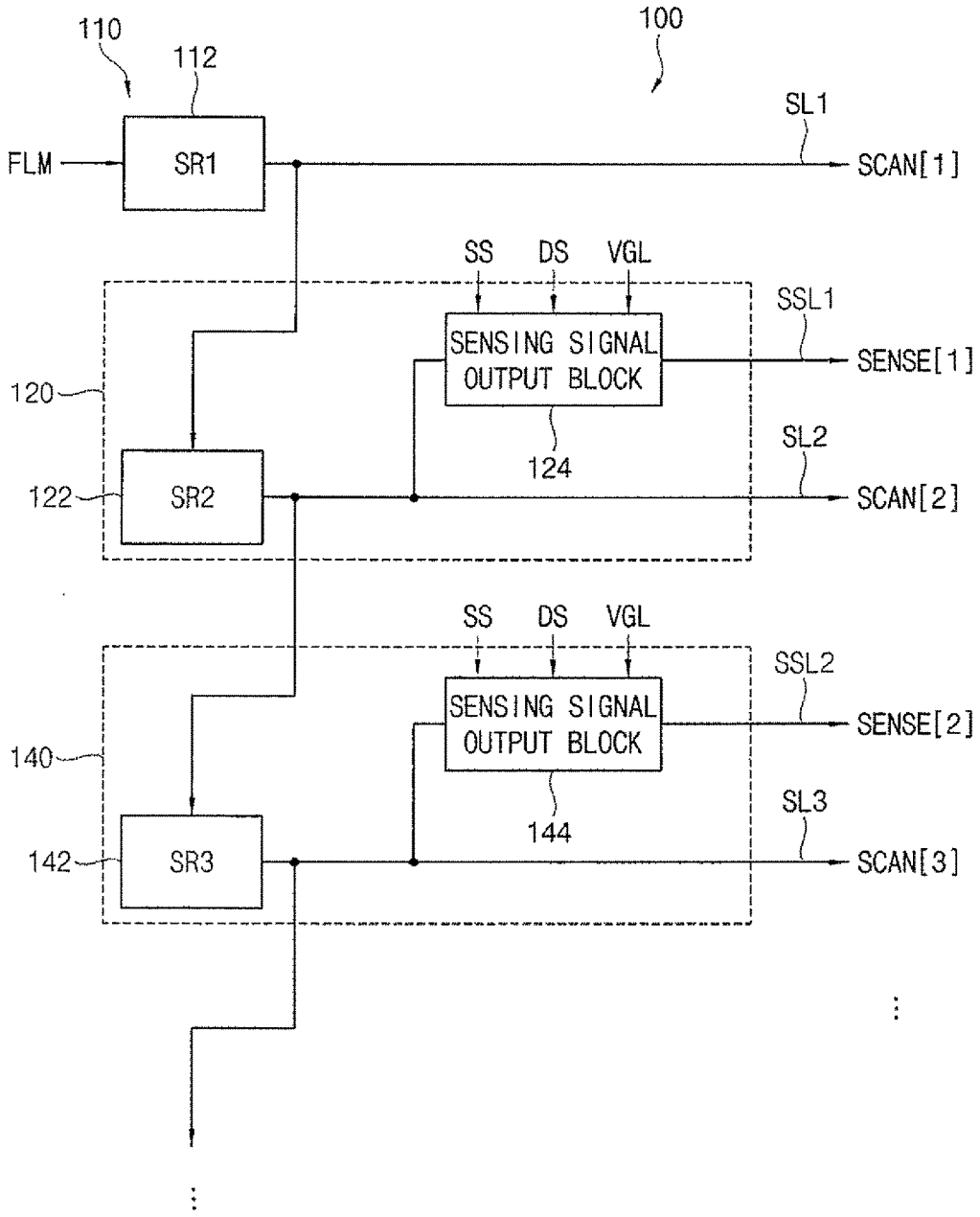
FIG. 1 is a block diagram of a gate driving circuit according to an example embodiment.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
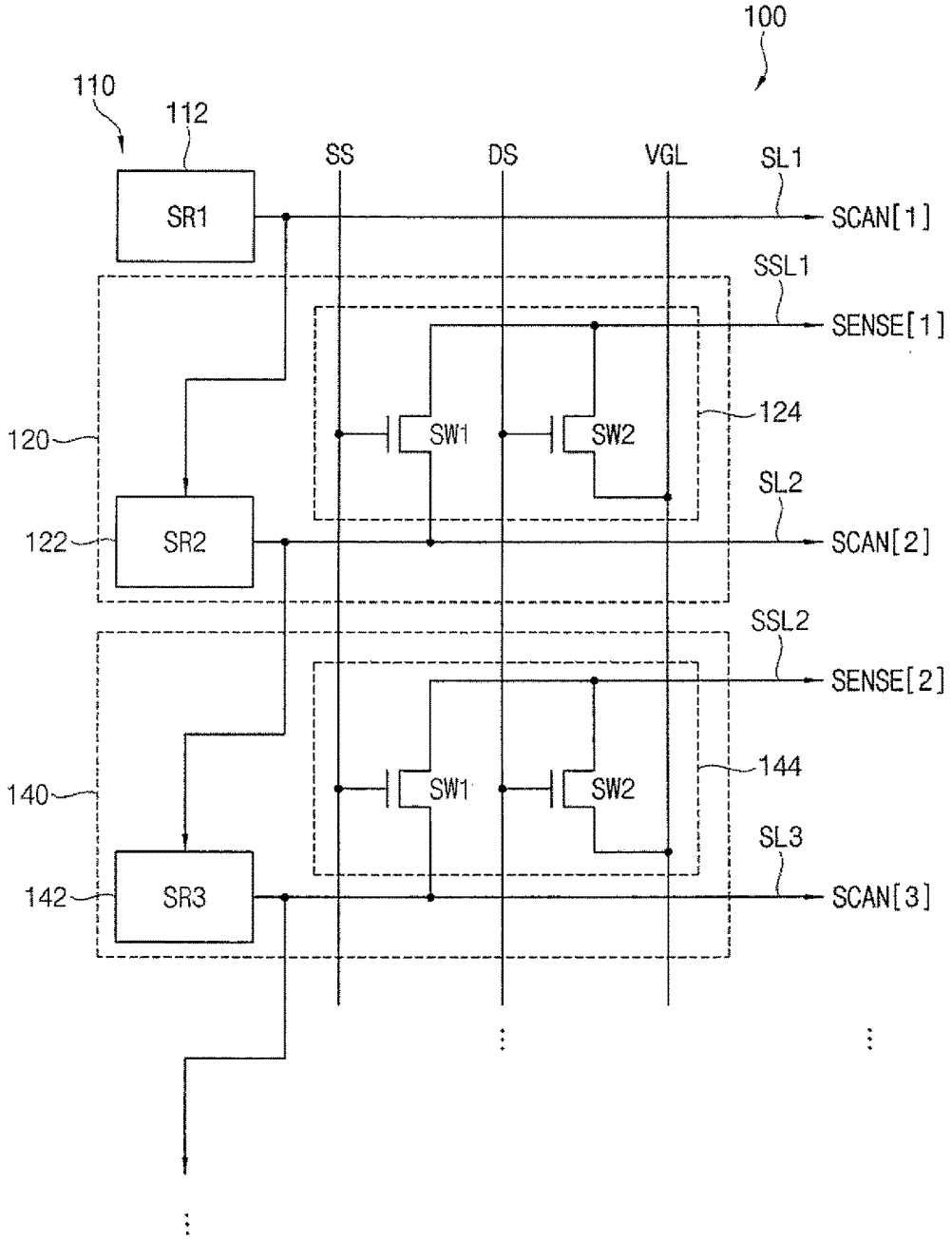
FIG. 2 is a diagram illustrating an example of the gate driving circuit of FIG. 1.

FIG. 1 is a block diagram of a gate driving circuit according to an example embodiment. FIG. 2 is a diagram illustrating an example of the gate driving circuit of FIG. 1.

Referring to FIGS. 1 and 2, the gate driving circuit 100 may include a plurality of stages 110, 120, 140, etc. connected to each other.

The stages 110, 120, 140, etc. may be connected to corresponding scan lines SL1, SL2, SL3, etc., and corresponding sensing lines SSL1, SSL2, SSL3, etc. The stages 110, 120, 140, etc. may output a plurality of scan signals SCAN[1], SCAN[2], SCAN[3], etc. via the scan lines SL1, SL2, SL3, etc., respectively, and may output a plurality of sensing signals SENSE[1], SENSE[2], SENSE[3], etc. via the sensing lines SSL1, SSL2, SSL3, etc., respectively.

Each of the stages 110, 120, 140, etc. may include a shift register 112, 122, 142, etc., and a sensing signal output block 124, 144, etc. The shift register 112, 122, 142, etc. may output a K-th scan signal corresponding to a K-th pixel row, where K is an integer greater than 0. The sensing signal output block 124, 144, etc. may output a (K−1)-th sensing signal corresponding to a (K−1)-th pixel row.

The plurality of shift registers 112, 122, 142, etc. may be connected to each other. The shift registers 112, 122, 142, etc. may sequentially output shifted scan signals SCAN[1], SCAN[2], SCAN[3], etc., based on input signals (e.g., FLM, SCAN[1], SCAN[2], etc. in FIG. 1), respectively. A frame start signal FLM or a previous stage scan signal may be provided to the shift register 112, 122, 142, etc. For example, the frame start signal FLM may be provided to the shift register 112 of a first stage (e.g., SR1), and the first scan signal SCAN[1] may be provided to the shift register 122 of the second stage 120 (e.g., SR2). In one or more example embodiments, the shift registers 112, 122, 142, etc. may include various suitable circuits that pull up and pull down the scan signal using the input signal and a plurality of clock signals.

In an embodiment, the first stage 110 may include (e.g., only include) the shift register 112, without including the sensing signal output block, and may output the first scan signal SCAN[1] based on the frame start signal FLM.

An N-th stage (e.g., 120, 140, etc.) may include the sensing output block (e.g., 122, 144, etc.), where N is an integer greater than 1. The shift register 122, 142, etc. of the N-th stage (e.g., 120, 140, etc.) may output an N-th scan signal (e.g., SCAN[2], SCAN[3], etc.) based on an (N−1)-th scan signal (e.g., SCAN[1], SCAN[2], etc.).

According to one or more example embodiments, n-channel metal-oxide semiconductor (NMOS) transistors are used. For example, the signals applied to gate electrodes of the NMOS transistors are activated with a logical high level. However, the inventive concept is not limited thereto, and at least some of the transistors may be implemented with p-channel metal-oxide semiconductor (PMOS) transistors, and the signals applied to the gate electrodes of the PMOS transistors can be activated with a logical low level.

The sensing signal output block (e.g., 124) may be connected to an output of the shift register (e.g., 122). The sensing signal output block 124 may output an (N−1)-th sensing signal (e.g., SENSE[1]) for an external compensation with respect to a pixel based on a sensing control signal SS and a data control signal DS. For example, the sensing signal output block 124 of the second stage 120 may output a first sensing signal SENSE[1] applied to a first pixel row, based on the second scan signal SCAN[2], the sensing control signal SS, and the data control signal DS. Similarly, the sensing signal output block 144 of the third stage 140 may output a second sensing signal SENSE[2] applied to a second pixel row, based on the third scan signal SCAN[3], the sensing control signal SS, and the data control signal DS. The sensing control signal SS may correspond to a signal that sinks a sensing current generated in a pixel (or a pixel row) to a sensing circuit. Accordingly, the sensing circuit may receive the sensing current by the sensing control signal SS, and may perform the external compensation with respect to the pixels. The data control signal DS may correspond to a signal that controls providing a data voltage or sensing voltage generated in a data driving circuit to the pixels via a data line.

The sensing signal control block 124 of the second stage 120 may include a first switch SW1 and a second switch SW2. The first switch SW1 may be connected to the output terminal of the shift register 122, and may be configured to output the first sensing signal SENSE[1] to have an active level (e.g., a logical high level), based on the sensing control signal SS. The second switch SW2 may be connected to a voltage (e.g., a direct current (DC) voltage) VGL, and may be configured to change the active level (e.g., the logical high level) of the first sensing signal SENSE[1] into an inactive level (e.g., a logical low level), based on the data control signal DS.

In an embodiment, the first switch SW1 may include a gate electrode configured to receive the sensing control signal SS, a first electrode configured to receive the N-th scan signal, and a second electrode connected to an (N−1)-th sensing line to which the (N−1)-th sensing signal is output.

The second switch SW2 may include a gate electrode configured to receive the data control signal DD, a first electrode configured to receive the voltage (e.g., the DC voltage) VGL, and a second electrode connected to the (N−1)-th sensing line.

For example, in the second stage 120, the first switch SW1 may include a gate electrode configured to receive the sensing control signal SS, a first electrode configured to receive the second scan signal SCAN[2], and a second electrode connected to a first sensing line SSL1. The second switch SW2 may include a gate electrode configured to receive the data control signal DD, a first electrode configured to receive the voltage VGL, and a second electrode connected to the first sensing line SSL1.

Outputs of the sensing signals SENSE[1], SENSE[2], etc. may be controlled by switching operations of the first and second switches SW1 and SW2, such that the sensing signals SENSE[1], SENSE[2], etc. may be sequentially output in the sensing mode. Accordingly, the N-th scan signal and the (N−1)-th sensing signal may share the output of a single shift register in each stage.

As described above, the gate driving circuit 100 may include stages 110, 120, 140, etc., each stage including a single shift register 112, 122, 142, etc. and switches SW1 and SW2 for outputting the scan signals SCAN[1], SCAN[2], SCAN[3], etc. and the sensing signals SENSE[1], SENSE[2], etc., without any additional shift registers for sequentially outputting the sensing signals SENSE[1], SENSE[2], etc. Thus, the structure of the gate driving circuit 100 may be simplified, and the output reliability of the gate driving circuit 100 may be improved. For example, when the gate driving circuit 100 is embedded in a display panel, a narrow bezel or a zero bezel display device driven by the external compensation scheme may be implemented by a simple structure of the gate driving circuit 100.

Figure 3:
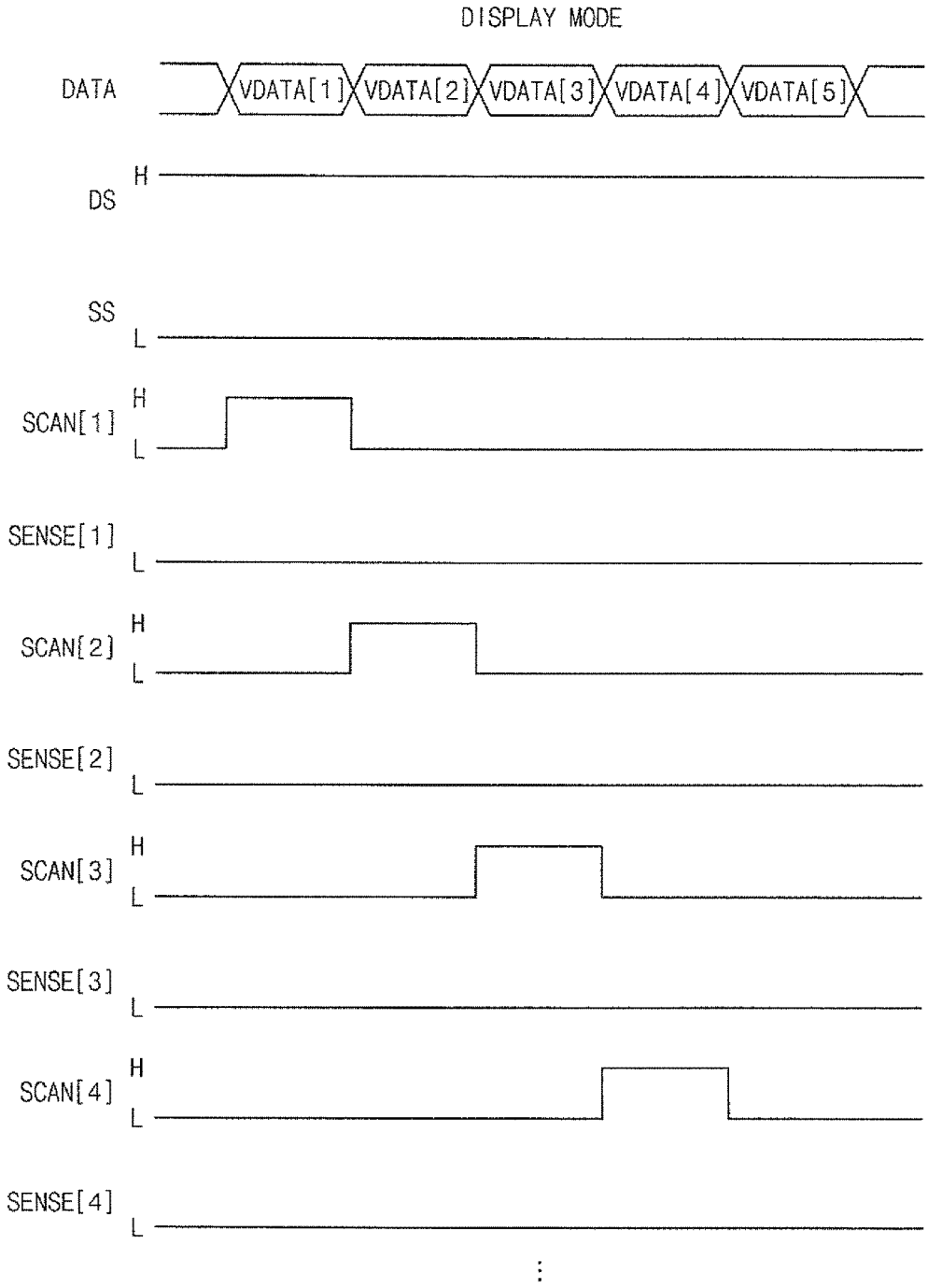
FIG. 3 is a timing diagram for an operation of the gate driving circuit of FIG. 1 in a display mode.
Figure 4:
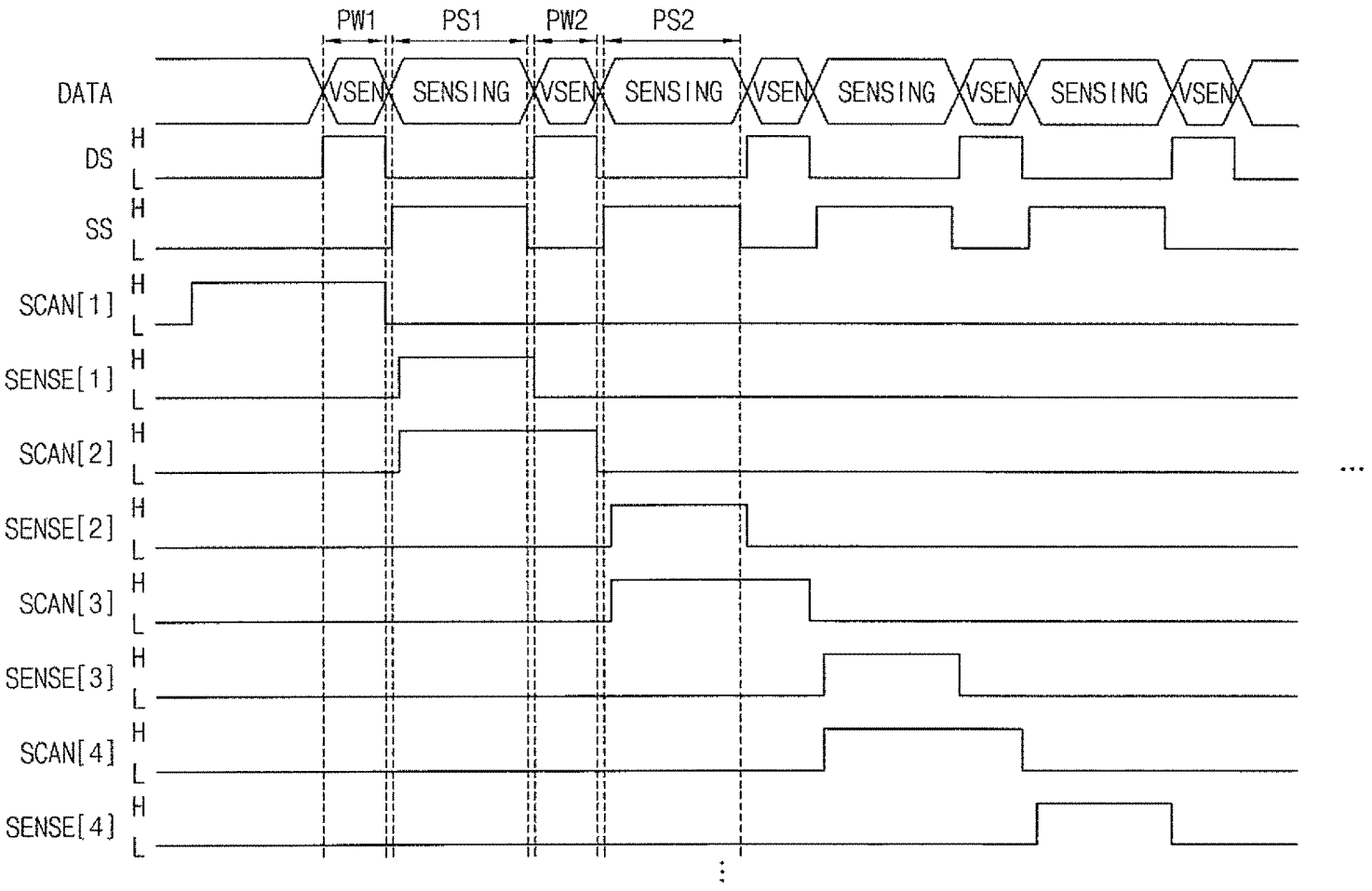
FIG. 4 is a timing diagram for an operation of the gate driving circuit of FIG. 1 in a sensing mode.

FIG. 3 is a timing diagram for an operation of the gate driving circuit of FIG. 1 in a display mode. FIG. 4 is a timing diagram for an operation of the gate driving circuit of FIG. 1 in a sensing mode.

Referring to FIGS. 1 through 4, the gate driving circuit 100 may operate in the display mode differently from the sensing mode.

A display panel may display images in the display mode. The external compensation with respect to the pixels may be performed by sensing degradation of the pixels, variations of the threshold voltage/mobility, etc. in the sensing mode. In an embodiment, the sensing mode may be activated during a time (e.g., a predetermined time) when the display panel (or a screen) is turned on and/or turned off. In an embodiment, the sensing mode may be periodically activated.

As illustrated in FIG. 3, the sensing signal output block may maintain or substantially maintain the (N−1)-th sensing signal (e.g., SENSE[1], SENSE[2], etc.) to have, for example, a logical low level L in the display mode. Accordingly, the pixel sensing operation may not be performed in the display mode. For example, a sensing transistor included in the pixel for receiving the sensing signal (e.g., SENSE[1], SENSE[2], etc.) may be turned off by the logical low level L of the sensing signal.

In one embodiment, a data control signal DS may have, for example, the logical high level H in the display mode, and a sensing control signal SS may have, for example, the logical low level L in the display mode. In this case, the first switch SW1 may be turned on by receiving the sensing control signal SS, and the second control switch SW2 may be turned off by receiving the data control signal DS. Thus, the voltage (e.g., the DC voltage) VGL may be output to all of the sensing lines SSL1, SSL2, etc. In an embodiment, a voltage level of the voltage VGL may correspond to the logical low level L.

Accordingly, in the display mode, the gate driving circuit 100 may sequentially output the scan signals SCAN[1], SCAN[2], etc. by the shift registers that are connected to one another, and may maintain or substantially maintain the logical low level L of the sensing signals SENSE[1], SENSE[2], etc.

As illustrated in FIG. 4, in the sensing mode, the gate driving circuit 100 may sequentially output the scan signals SCAN[1], SCAN[2], etc. each having the logical high level H, and may sequentially output the sensing signals SENSE[1], SENSE[2], etc. each having the logical high level H.

In an embodiment, the sensing mode may include a writing period (e.g., PW1, PW2, etc.) for writing a sensing voltage to the pixel and a sensing period (e.g., PS1, PS2, etc.) for sensing a sensing current that is generated based on a sensing voltage VSEN. The data control signal DS may have the logical high level H during the writing period PW1, PW2, etc., and the sensing control signal SS may have the logical high level H during the sensing period PS1, PS2, etc.

The first scan signal SCAN[1] and the data control signal DS may have the logical high level during a first writing period PW1, which is the writing period with respect to the first pixel row. Accordingly, the sensing voltage VSEN may be written at the first pixel row. At this time, the second scan signal SCAN[2] may have the logical low level L, such that the first sensing signal SENSE[1] may have the logical low level L.

In a first sensing period PS1 with respect to the first pixel row, the first scan signal SCAN[1] may be changed to the logical low level L, and the second scan signal SCAN[2] and the sensing control signal SS may have the logical high level H. In addition, the data control signal DS may be changed to the logical low level L. Accordingly, the first switch SW1 of the sensing signal output block 124 in the second stage 120 may be turned on, and the second switch SW of the sensing signal output block 124 may be turned off, such that the first sensing signal SENSE[1] having the logical high level H may be output. The output of the second scan signal SCAN[2] and the output the first sensing signal SENSE[1] may share the output of the shift register 122 of the second stage 120. For example, when the shift register 122 outputs a signal having the logical high level H, the second scan signal SCAN[2] and the first sensing signal SENSE[1] may be concurrently changed to the logical high level H.

During a second writing period PW2 with respect to a second pixel row, the data control signal DS may be changed to the logical high level H, and the sensing control signal SS may be changed to the logical low level L. The second scan signal SCAN[2] may maintain or substantially maintain the logical high level H during the second writing period PW2. Accordingly, the first switch SW1 of the sensing signal output block 124 in the second stage 120 may be turned off, and the second switch SW2 of the sensing signal output block 124 may be turned on, such that the first sensing signal SENSE[1] having the logical low level L may be output. The sensing voltage VSEN may be written at the second pixel row.

Then, in a second sensing period PS2 with respect to the second pixel row, the second scan signal SCAN[2] may be changed to the logical low level L, and a third scan signal SCAN[3] and the sensing control signal SS may have the logical high level H. The data control signal DS may be also changed to the logical low level L. Accordingly, the first switch SW1 of the sensing signal output block 144 in the third stage 140 may be turned on and the second switch SW of the sensing signal output block 144 may be turned off, such that the second sensing signal SENSE[2] having the logical high level H may be output.

Similarly, following stages may sequentially output the logical high level H of the scan signals and the sensing signals. Accordingly, the output of the N-th scan signal and the output of the (N−1)-th sensing signal may share the output of the shift register of the N-th stage. Also, in the sensing mode, a period in which the (N−1)-th sensing signal has the logical high level H may overlap a portion of a period in which the N-th scan signal has the logical high level H.

As described above, the gate driving circuit 100 may include stages for outputting the scan signals SCAN[1], SCAN[2], etc. and the sensing signals SENSE[1], SENSE [2], etc., each of the stages including a single shift register and switches SW1 and SW2, without any additional shift registers for sequentially outputting the sensing signals SENSE[1], SENSE[2], etc. Thus, the structure of the gate driving circuit 100 may be simplified, and thus, the output reliability of the gate driving circuit 100 may be improved. For example, when the gate driving circuit 100 is embedded in a display panel, a narrow bezel or a zero bezel display device driven by the external compensation scheme may be implemented by the simple structure of the gate driving circuit 100.

Figure 5:
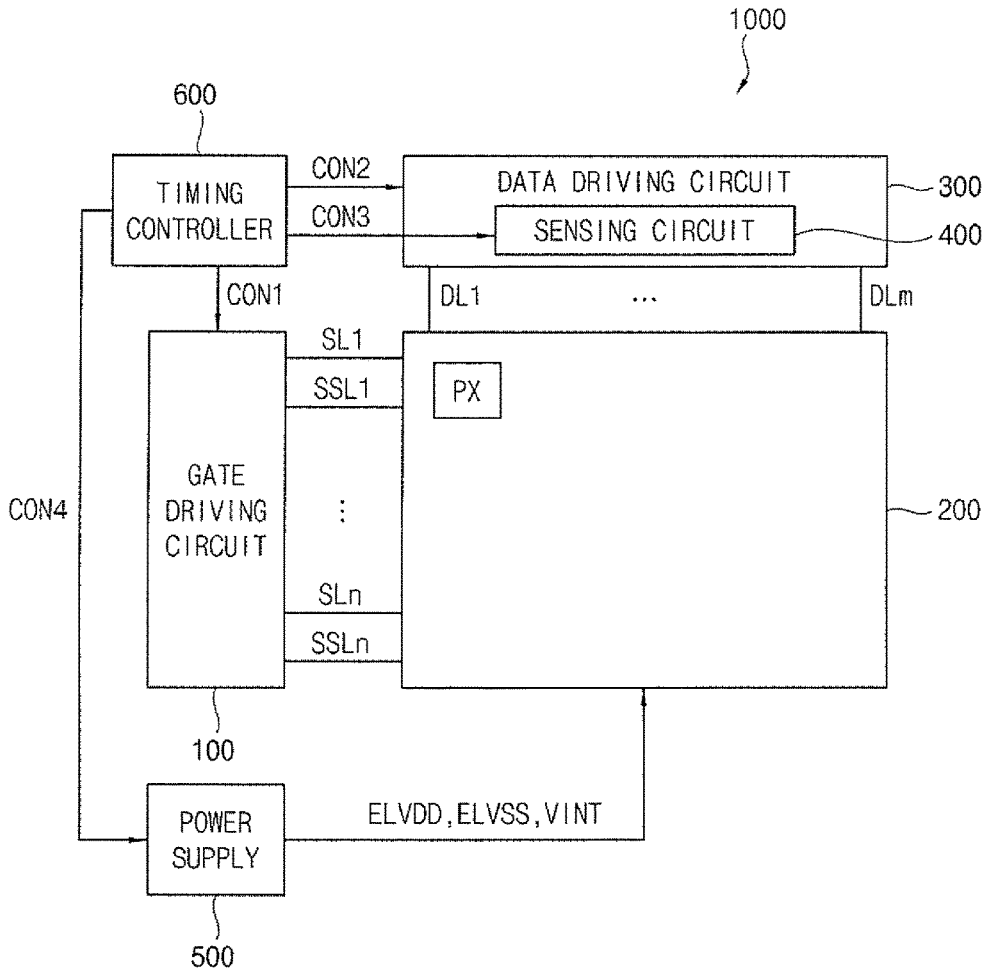
FIG. 5 is a block diagram of an organic light emitting display device according to an example embodiment.

FIG. 5 is a block diagram of an organic light emitting display device according to an example embodiment.

Referring to FIG. 5, the organic light emitting display device 1000 may include a gate driving circuit 100, a display panel 200, a data driving circuit 300, a sensing circuit 400, a power supply 500, and a timing controller 600. In an embodiment, the organic light emitting display device 1000 may further include an emission driving circuit for generating an emission control signal to control emission of a plurality of pixels PX.

The organic light emitting display device 1000 may be driven by a display mode and a sensing mode. The display panel 200 may display images in the display mode. An external compensation with respect to the pixels PX for compensating degradation of the pixels PX may be performed in the sensing mode. In an embodiment, the sensing mode may be activated during a time (e.g., a predetermined time) when the display panel 200 is turned on and/or turned off. In an embodiment, the sensing mode may be periodically activated.

The display panel 200 may display images. The display panel 200 may include a plurality of scan lines SL1 through SLn, a plurality of sensing lines SSL1 through SSLn, and a plurality of data lines DL1 through DLm. The display panel 200 may also include the pixels PX connected to the scan lines SL1 through SLn, the sensing lines SSL1 through SSLn, and the data lines DL1 through DLm. For example, the pixels PX may be disposed in a matrix form. In some embodiments, the number of pixels PX may be equal to n×m, where n and m are integers greater than 0.

The gate driving circuit 100 may output a plurality of scan signals to the scan lines SL1 through SLn, and may output a plurality of sensing signals to the sensing lines SSL1 through SSLn. The gate driving circuit 100 may output the scan signals and the sensing signals based on a first control signal CON1 received from the timing controller 600. The gate driving circuit 100 may include a plurality of stages for outputting the scan signals and sensing signals. The gate driving circuit 100 may sequentially provide the scan signals to the display panel 200 in the display mode and the sensing mode. The gate driving circuit 100 may sequentially provide the sensing signals to the display panel 200 based on a data control signal and a sensing control signal in the sensing mode. In an embodiment, the gate driving circuit 100 may include a plurality of NMOS transistors. The gate driving circuit 100 may be embedded in the display panel 200.

An N-th stage in the gate driving circuit may include a shift register and a sensing signal output block, where N is an integer greater than 1.

The shift register may output an N-th scan signal based on an (N−1)-th scan signal. The shift register of a first stage may receive a frame start signal, and may output a first scan signal.

The sensing signal output block may be connected to the shift register, and may be configured to output an (N−1)-th sensing signal for the external compensation based on the sensing control signal and the data control signal. In an embodiment, the sensing signal output block may include a first switch and a second switch. The first switch may be connected to the output terminal of the shift register, and may be configured to output the (N−1)-th sensing signal to have an active level (e.g., a logical high level), based on the sensing control signal. The second switch may be connected to a voltage (e.g., a direct current (DC) voltage), and may be configured to change the active level of the (N−1)-th sensing signal to an inactive level (e.g., a logical low level), based on the data control signal.

Accordingly, the N-th scan signal and the (N−1)-th sensing signal may share the output of the single shift register of the N-th stage in the sensing mode.

In an embodiment, the sensing signal output block may maintain or substantially maintain the (N−1)-th sensing signal to have the logical low level in the display mode. In an embodiment, the sensing signal output block may output the (N−1)-th sensing signal having the logical high level during a period (e.g., a predetermined period) in the sensing mode.

Since the gate driving circuit 100 is described above with reference to FIGS. 1 through 4, duplicated descriptions will not be repeated.

The data driving circuit 300 may convert a data signal received from the timing controller 600 into a data voltage (e.g., an analog data voltage) based on a second control signal CON2 received from the timing controller 600. The data driving circuit 300 may output the data voltage to the data lines DL1 through DLm. In the display mode, the data driving circuit 300 may provide the data voltage corresponding to a display image to the display panel 200. In the sensing mode, the data driving circuit 300 may provide a sensing voltage to the display panel 200 based on the data control signal.

The sensing circuit 400 may perform the external compensation with respect to the pixels PX based on a sensing current generated in the pixels PX in the sensing mode. In an embodiment, the sensing circuit 400 may be electrically connected to the data lines DL1 through DLm based on a third control signal CON3 (e.g., the sensing control signal) received from the timing controller 600, so as to receive the sensing current. The sensing circuit 400 may detect the degradation of the pixels PX based on the sensing current, and may calculate (or compensate) a data voltage for compensating the degradation.

In an embodiment, the sensing circuit 400 and the data driving circuit 300 may be integrated in a single driving circuit integrated circuit (IC).

The power supply 500 may provide a first power voltage ELVDD, a second power voltage ELVSS, and an initialization voltage VINT to the display panel 200 based on a fourth control signal CON4 received from the timing controller 600, The second power voltage ELVSS may be less than the first power voltage ELVDD. The initialization voltage VINT may initialize an organic light emitting diode in each of the pixels PX. In an embodiment, in the sensing mode, the power supply 500 may raise the second power voltage ELVSS to have a voltage level that is the same or substantially the same as that of the first power voltage ELVDD. Thus, reverse bias of the organic light emitting diode may be prevented or substantially prevented, and accurate sensing currents may be transmitted to the sensing circuit 400.

The timing controller 600 may control the gate driving circuit 100, the data driving circuit 300, the sensing circuit 400, and the power supply 500. The timing controller 600 may receive an input control signal and an input image signal from an image source, such as an external graphic apparatus. The timing controller 600 may generate the data signal (e.g., a digital data signal) corresponding to operating conditions of the display panel 200 based on the input image signal. In addition, the timing controller 600 may generate the first control signal CON1 for controlling a driving timing of the gate driving circuit 100, the second control signal CON2 for controlling a driving timing of the data driving circuit 300, and the third control signal CON3 for controlling the sensing circuit 400, based on the input control signal. The timing controller 600 may output the first to third control signals CON1, CON2, and CON3 to the gate driving circuit 100, the data driving circuit 300, and the sensing circuit 400, respectively.

Accordingly, the organic light emitting display device 1000 driven by the external compensation scheme may include the gate driving circuit 100 configured to output the N-th scan signal and the (N−1)-th sensing signal by sharing the single shift register, such that the gate driving circuit 100 may be simplified. Thus, the output reliability of the gate driving circuit 100 may be improved and the narrow bezel or the zero bezel display may be implemented.

Figure 6:
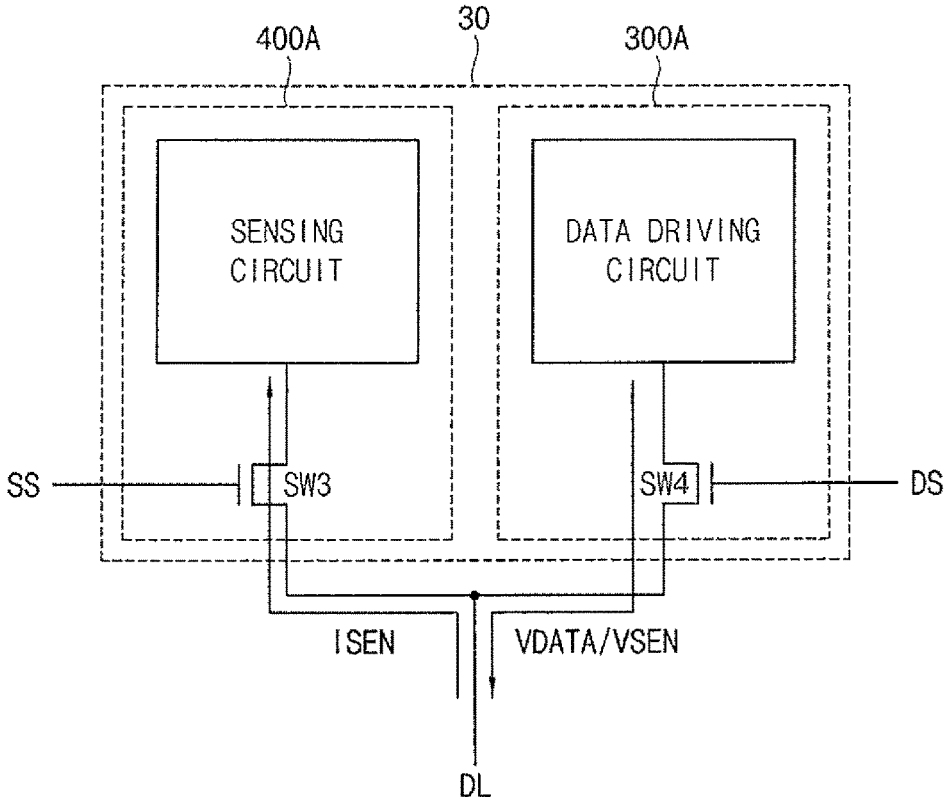
FIG. 6 is a diagram illustrating an example of a data driving circuit included in the organic light emitting display device of FIG. 5.

FIG. 6 is a diagram illustrating an example of a data driving circuit included in the organic light emitting display device of FIG. 5.

Referring to FIG. 6, the data driving circuit 300A may be electrically connected to the data line DL and the pixels that are connected the data lines DL based on the data control signal DS, and the sensing circuit 400A may be electrically connected to the data line DL and the pixels based on the sensing control signal SS.

In an embodiment, the data driving circuit 300A and the sensing circuit 400A may be integrated in a single drive IC. The data control signal DS and the sensing control signal SS may be provided from the timing controller 600.

The sensing circuit 400A may include a first control switch SW3 (e.g., a sensing control switch). The first control switch SW3 may have a gate electrode for receiving the sensing control signal SS, and may transmit a sensing current ISEN from the pixels PX to the sensing circuit 400A via the data line DL. The data driving circuit 300A may include a second control switch SW4 (e.g., a data control switch). The second control switch SW4 may have a gate electrode for receiving the data control signal DS, and may transmit the data voltage VDATA or the sensing voltage VSEN from the data driving circuit 300A to the pixels PX via the data line DL.

As illustrated in FIG. 3, in the display mode, the data control signal DS may have the logical high level H, and the sensing control signal SS may have the logical low level L. Thus, the data driving circuit 300A may be electrically connected to the data line DL in the display mode, such that the data voltage VDATA may be provided to the pixels PX via the data line DL.

In the sensing mode, the sensing circuit 400A may receive the sensing current ISEN from the data line DL based on the sensing control signal SS. In some embodiments, the sensing mode may include a writing period for writing the sensing voltage VSEN to the pixels PX and a sensing period for sensing the sensing current ISEN that is generated based on the sensing voltage VSEN.

As illustrated in FIG. 4, in the writing period, the data control signal may have the logical high level H and the sensing control signal SS may have the logical low level L. Thus, the data line DL may be electrically connected to the data driving circuit 300A during the writing period, such that the sensing voltage VDATA may be provided to the pixels PX.

In the sensing period, the data control signal DS may have the logical low level L and the sensing control signal SS may have the logical high level H. Thus, the data line DL may be electrically connected to the sensing circuit 400A, such that the sensing current ISEN may be provided to the sensing circuit 400A.

Accordingly, the data control signal DS and the sensing control signal SS may respectively control connections between the data driving circuit 300A and the data line DL, and between the sensing circuit 400A and the data line DL. In addition, the data control signal DS and the sensing control signal SS may control the operations of the gate driving circuit 100, the data driving circuit 300A, and the sensing circuit 400A.

Figure 7A:
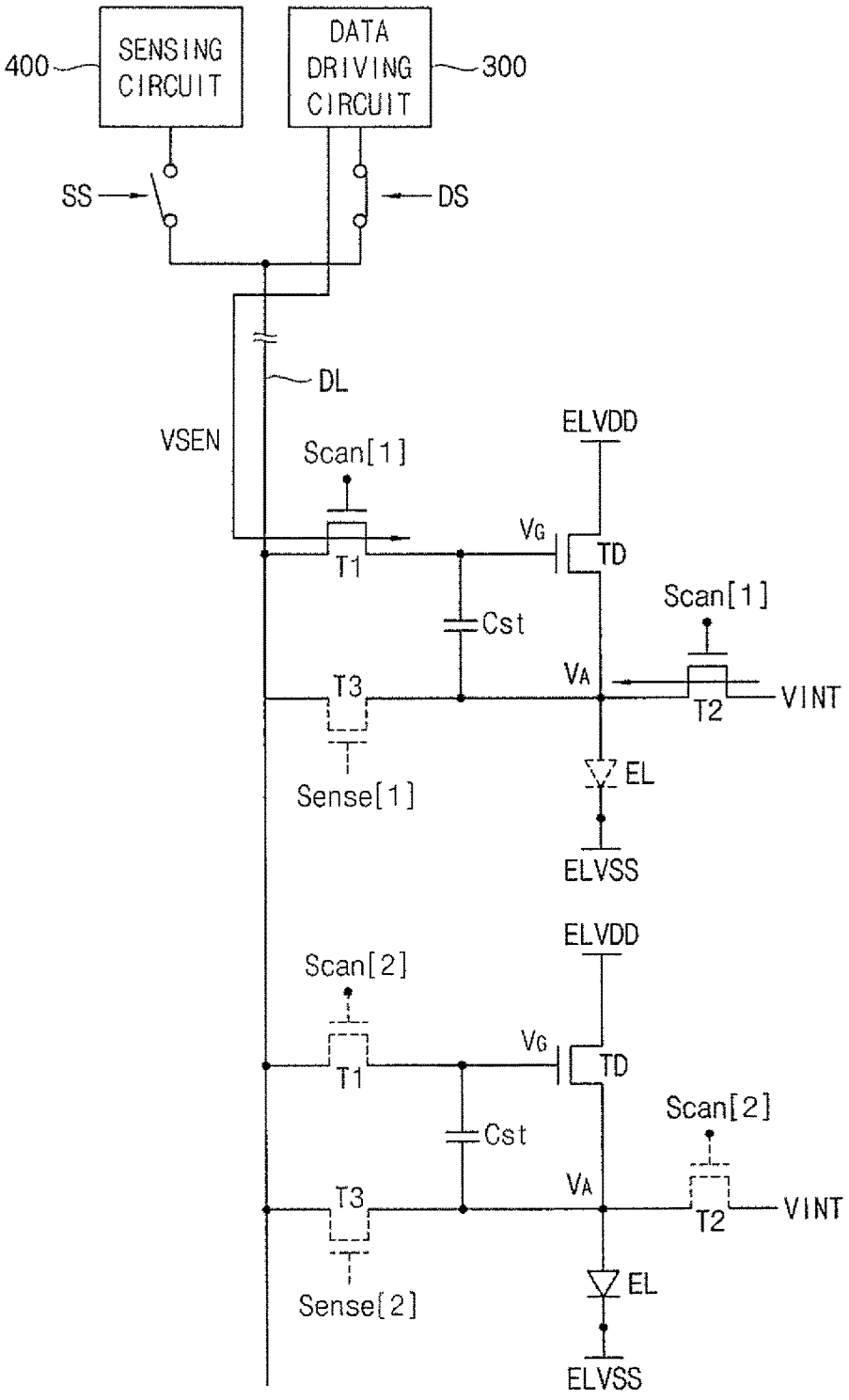
FIGS. 7A-7C are diagrams illustrating an operation of the organic light emitting display device of FIG. 5 in a sensing mode.
Figure 7B:
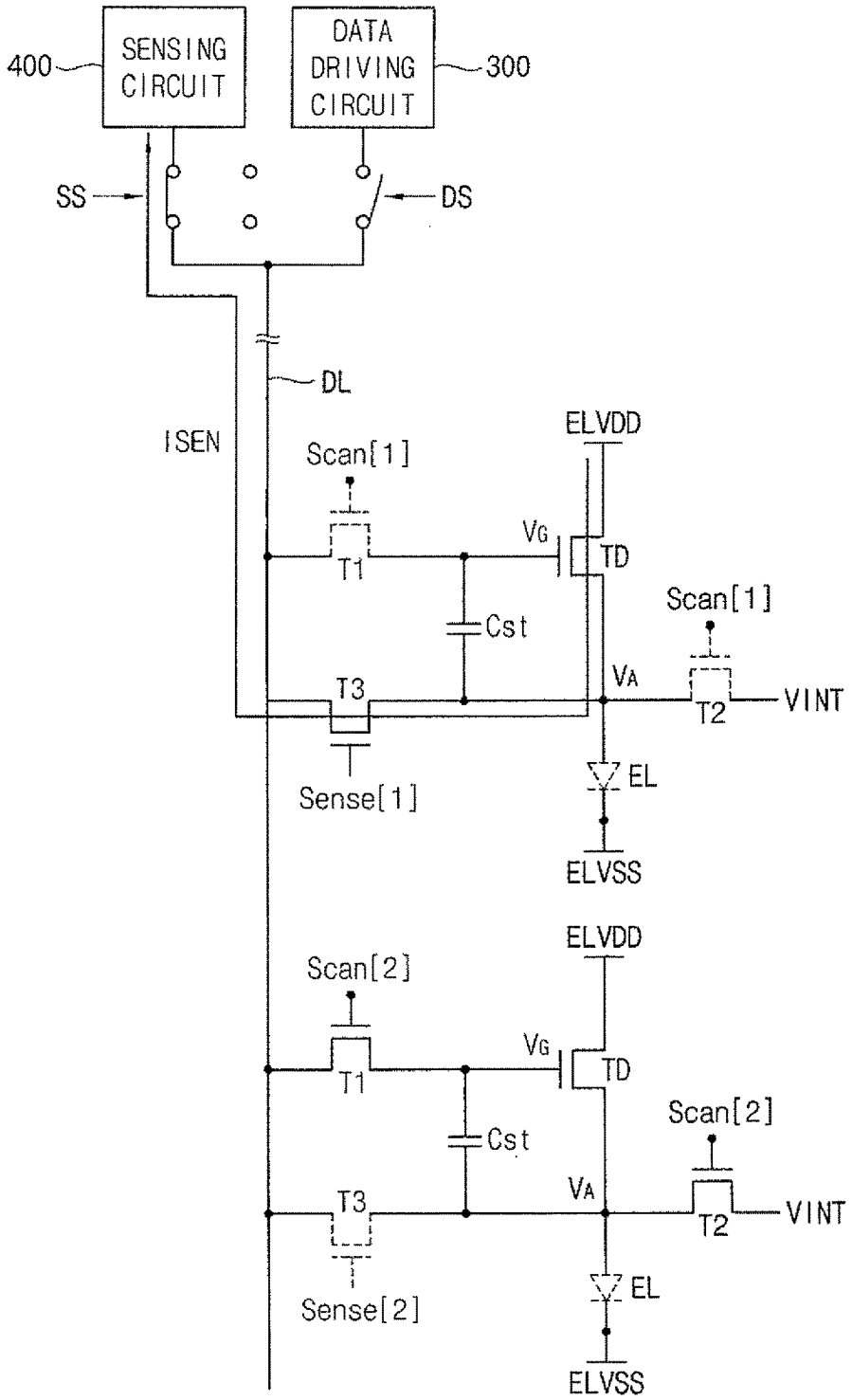
Figure 7C:
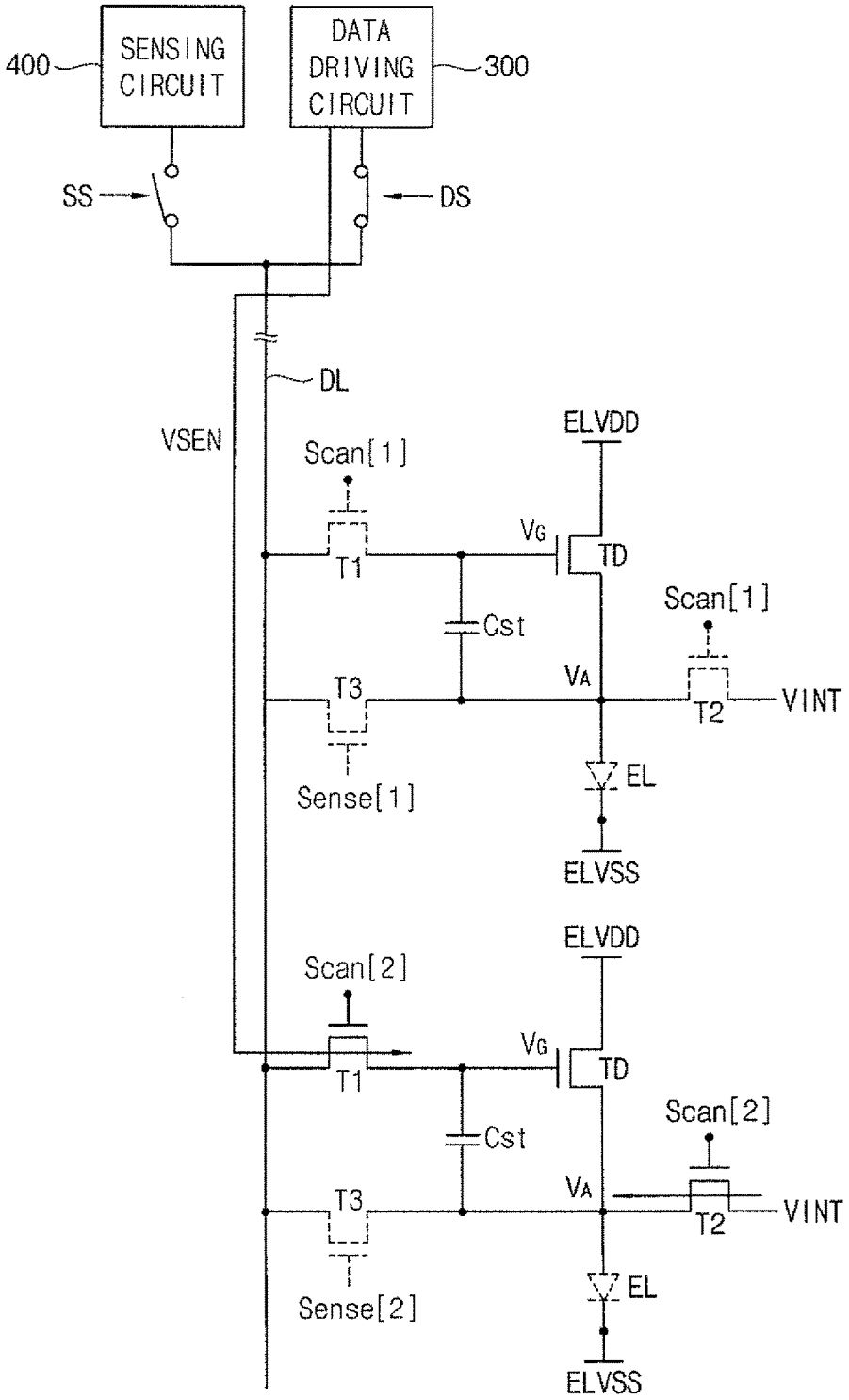

FIGS. 7A through 7C are diagrams illustrating an operation of the organic light emitting display device of FIG. 5 in a sensing mode.

Referring to FIGS. 7A through 7C, degradation sensing operation with respect to the pixels may be sequentially performed in the sensing mode.

Each of the pixels may include an organic light emitting diode EL, a scan transistor T1, a storage capacitor Cst, a driving transistor TD, an initialization transistor T2, and a sensing transistor T3.

Hereinafter, a pixel in a first pixel row and a pixel in a second pixel row will be described with reference to FIGS. 7A through 7C.

The scan transistor T1 may be connected between the data line DL and a gate electrode of the driving transistor TD. The scan transistor T1 may transmit the sensing voltage VSEN to the gate electrode of the driving transistor TD in response to the scan signal.

The storage capacitor Cst may be connected between the gate electrode of the driving transistor TD and a source electrode (e.g., VA of FIG. 7A) of the driving transistor TD. When the scan transistor T1 is turned on, the storage capacitor Cst may store a voltage difference between the sensing voltage VSEN and a voltage of the source voltage VA of the driving transistor TD.

The driving transistor TD may be connected to the first power voltage ELVDD. The driving transistor TD may generate a sensing current ISEN corresponding to a charged voltage at the storage capacitor Cst based on the sensing voltage VSEN.

The initialization transistor T2 may provide the initialization voltage VINIT to the second electrode (e.g., the source electrode) of the driving transistor TD (e.g., or an anode of the organic light emitting diode EL) in response to the scan signal. The initialization voltage VINT may be, for example, a ground voltage.

The sensing transistor T3 may be connected between the data line DL and the source electrode of the driving transistor TD. The sensing transistor T3 may transmit the sensing current ISEN to the data line DL in response to the sensing signal.

As illustrated in FIGS. 4 and 7A, during the writing period PW1 with respect to the first pixel row, the first scan signal SCAN[1] and the data control signal DS may have the logical high level H. Thus, the scan transistor T1 and the initialization transistor T2 may be turned on. The sensing voltage VSEN may be written at the gate electrode VG of the driving transistor TD, and the initialization voltage VINT may be applied to the source electrode of the driving transistor TD. Thus, a specific voltage (e.g., VSEN-VINT) may be charged at the storage capacitor Cst. Here, the sensing transistor T3 may be in a turned-off state. In an embodiment, the second power voltage ELVSS may be changed to a voltage level that is the same or substantially the same as that of the first power voltage ELVDD.

As illustrated in FIGS. 4 and 7B, during the sensing period PS1 with respect to the first pixel row, the first scan signal SCAN[1] may be changed to the logical low level L, and the second scan signal SCAN[2] and the sensing control signal SS may have the logical high level H. In addition, the data control signal DS may be changed to the logical low level L. Here, the scan transistor T1 and the initialization transistor T2 may be turned off, and the sensing transistor T3 may be turned on. Thus, the sensing current ISEN of the first pixel row may be provided to the sensing circuit 400 via the data line DL.

As illustrated in FIGS. 4 and 7C, during the writing period PW2 with respect to the second pixel row, the data control signal DS may be changed to the logical high level H, and the sensing control signal SS may be changed to the logical low level L. The second scan signal SCAN[2] may maintain the logical high level H during the second writing period PW2. The sensing voltage VSEN may be written at a gate electrode of a driving transistor TD of the second pixel row, and the initialization voltage VINT may be applied to a source electrode of the driving transistor TD of the second pixel row. Thus, a specific voltage (e.g., VSEN-VINT) may be charged at the storage capacitor Cst of the second pixel row. Here, the scan transistor T1 of the first pixel row, the initialization transistor T2 of the first pixel row, and the sensing transistor T3 of the first pixel row may be turned off.

Accordingly, the organic light emitting display device 1000 driven by the external compensation scheme may include the gate driving circuit configured to output the N-th scan signal and the (N−1)-th sensing signal by sharing the single shift register, such that the gate driving circuit 100 may be simplified. Thus, the output reliability of the gate driving circuit 100 may be improved and the narrow bezel or the zero bezel display may be implemented.

The example embodiments of the inventive concept may be applied to any suitable display device and any suitable system including the display device. For example, the example embodiments may be applied to an organic light emitting display device, a liquid crystal display device, etc., and/or may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The electronic or electric devices (e.g., the shift registers, timing controller, control signal generator, etc.) and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

The foregoing is illustrative of example embodiments, and is not to be construed as limiting thereof. Although a few example embodiments have been described, those skilled in the art will readily appreciate that various modifications are possible in the example embodiments, without departing from the aspect and features of the example embodiments. Accordingly, all such modifications are intended to be included within the spirit and scope of the inventive concept as defined in the claims and their equivalents. In the claims, means-plus-function clauses, if any, are intended to cover the structures described herein as performing the recited function, and not only structural equivalents but also equivalent structures. Therefore, it is to be understood that the foregoing is illustrative of example embodiments and is not to be construed as limited to the specific embodiments disclosed herein, and that modifications to the disclosed example embodiments, as well as other example embodiments, are intended to be included within the spirit and scope of the appended claims and their equivalents. The inventive concept is defined by the following claims, with equivalents of the claims to be included therein.

What is claimed is:

1. A gate driving circuit comprising a plurality of stages configured to respectively output a plurality of scan signals, an N-th stage of the stages comprising:

a shift register configured to output an N-th scan signal based on an (N−1)-th scan signal; and a sensing signal output block configured to receive the N-th scan signal from the shift register, and configured to output an (N−1)-th sensing signal for compensation of a pixel based on the N-th scan signal, a sensing control signal, and a data control signal, where N is an integer greater than 1.

2. A gate driving circuit comprising a plurality of stages configured to respectively output a plurality of scan signals, an N-th stage of the stages comprising:

a shift register configured to output an N-th scan signal based on an (N−1)-th scan signal; and a sensing signal output block connected to the shift register and configured to output an (N−1)-th sensing signal for compensation of a pixel based on a sensing control signal and a data control signal, where N is an integer greater than 1, wherein the sensing signal output block comprises:

a first switch connected to an output terminal of the shift register and configured to output the (N−1)-th sensing signal having an active level, based on the sensing control signal; and a second switch connected to a voltage source and configured to change the active level of the (N−1)-th sensing signal to an inactive level, based on the data control signal.

3. The gate driving circuit of claim 2, wherein the first switch comprises:

a gate electrode configured to receive the sensing control signal;

a first electrode configured to receive the N-th scan signal; and a second electrode connected to an (N−1)-th sensing line, the (N−1)-th sensing line being configured to output the (N−1)-th sensing signal.

4. The gate driving circuit of claim 3, wherein the second switch comprises:

a gate electrode configured to receive the data control signal;

a first electrode configured to receive a voltage of the voltage source; and a second electrode connected to the (N−1)-th sensing line.

5. The gate driving circuit of claim 2, wherein the sensing signal output block is configured to maintain the (N−1)-th sensing signal at the inactive level in a display mode for displaying an image, and wherein the sensing signal output block is configured to output the (N−1)-th sensing signal at the active level in a sensing mode for the compensation.

6. The gate driving circuit of claim 5, wherein the data control signal has the active level and the sensing control signal has the inactive level in the display mode.

7. The gate driving circuit of claim 5, wherein the sensing mode comprises a writing period for writing a sensing voltage to the pixel and a sensing period for sensing a sensing current that is generated based on the sensing voltage, wherein the data control signal has the active level in the writing period, and wherein the sensing control signal has the active level in the sensing period.

8. The gate driving circuit of claim 7, wherein, in the sensing mode, a period in which the (N−1)-th sensing signal has the active level overlaps a portion of a period in which the N-th scan signal has the active level.

9. An organic light emitting display device comprising:

a display panel comprising a plurality of pixels configured to be driven by a display mode and a sensing mode;

a data driving circuit configured to provide a data voltage corresponding to an image to the display panel in the display mode, and to provide a sensing voltage to the display panel based on a data control signal;

a gate driving circuit including a plurality of stages configured to sequentially provide a plurality of scan signals to the display panel in the display mode and the sensing mode, and to sequentially provide a plurality of sensing signals to the display panel based on the data control signal and a sensing control signal in the sensing mode;

a sensing circuit configured to compensate the pixels based on a sensing current generated by the pixels in the sensing mode;

a power supply configured to provide a first power voltage and a second power voltage that is less than the first power voltage, to the display panel; and a controller configured to control the data driving circuit, the gate driving circuit, the sensing circuit, and the power supply, wherein an N-th stage of the stages includes:

a shift register configured to output an N-th scan signal based on an (N−1)-th scan signal; and a sensing signal output block configured to receive the N-th scan signal from the shift register, and configured to output an (N−1)-th sensing signal for compensation of the pixel based on the N-th scan signal, the sensing control signal and the data control signal, where N is an integer greater than 1.

10. The device of claim 9, wherein the sensing signal output block comprises:

a first switch connected to an output terminal of the shift register and configured to output the (N−1)-th sensing signal having an active level, based on the sensing control signal; and a second switch connected to a voltage source and configured to change the active level of the (N−1)-th sensing signal to an inactive level, based on the data control signal.

11. The device of claim 9, wherein the sensing signal output block is configured to maintain the (N−1)-th sensing signal at an inactive level in the display mode, and wherein the sensing signal output block is configured to output the (N−1)-th sensing signal at an active level in the sensing mode.

12. The device of claim 11, wherein the data control signal has the active level and the sensing control signal has the inactive level in the display mode.

13. The device of claim 12, wherein the sensing mode comprises a writing period for writing a sensing voltage to the pixels and a sensing period for sensing the sensing current, wherein the data control signal has the active level in the writing period, and wherein the sensing control signal has the active level in the sensing period.

14. The device of claim 13, wherein the sensing circuit is configured to receive the sensing current based on the sensing control signal in the sensing mode.

15. The device of claim 14, wherein the sensing circuit comprises a sensing control switch configured to receive the sensing current from the pixels and comprising a gate electrode configured to receive the sensing control signal.

16. The device of claim 13, wherein the data driving circuit comprises a data control switch configured to transmit the data voltage or the sensing voltage to the pixels and comprising a gate electrode configured to receive the data control signal.

17. The device of claim 13, wherein in the sensing mode, a period in which the (N−1)-th sensing signal has the active level overlaps a portion of a period in which the N-th scan signal has the active level.

18. The device of claim 13, wherein the power supply is configured to raise the second power voltage to have a voltage level that is the same as that of the first power voltage.

* * * * *